US010000053B2

(12) United States Patent
Caron et al.

(10) Patent No.: US 10,000,053 B2
(45) Date of Patent: Jun. 19, 2018

(54) WEB DISPLACER FOR A PRINTING UNIT

(71) Applicant: Goss International Americas, Inc., Durham, NH (US)

(72) Inventors: Glen Roger Caron, Deerfield, NH (US); Brian Joseph Gentle, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 114 days.

(21) Appl. No.: 15/150,638

(22) Filed: May 10, 2016

(65) Prior Publication Data

US 2017/0326872 A1 Nov. 16, 2017

(51) Int. Cl.
*B41F 13/02* (2006.01)
*B41F 21/00* (2006.01)

(52) U.S. Cl.
CPC ..... *B41F 21/00* (2013.01); *B41F 13/02* (2013.01)

(58) Field of Classification Search
None
See application file for complete search history.

(56) References Cited

U.S. PATENT DOCUMENTS

| | | | |
|---|---|---|---|
| 5,813,336 | A | 9/1998 | Guaraldi |
| 8,850,975 | B2 | 10/2014 | Zlatin |
| 2010/0126368 | A1 | 5/2010 | Zlatin |
| 2014/0102325 | A1 | 4/2014 | Caron |

*Primary Examiner* — Joshua D Zimmerman
(74) *Attorney, Agent, or Firm* — Davison, Davidson & Kappel, LLC

(57) ABSTRACT

A printing press is provided which includes a printing unit for printing on a web. The printing unit includes a plate cylinder, a blanket cylinder, and an impression cylinder. The press further includes a web displacement bar movable between a first position in which the web displacement bar is spaced apart from a web passing between the blanket cylinder and the impression cylinder, and a second position in which the web displacement bar holds the web in contact with the impression cylinder and spaced apart from the blanket cylinder. A method of operating the press is also provided.

12 Claims, 5 Drawing Sheets

WEB DISPLACER FOR A PRINTING UNIT

The present invention relates generally to printing units and more specifically to printing units of web offset printing presses for packaging applications.

BACKGROUND OF INVENTION

U.S. Pat. No. 5,813,336, which is hereby incorporated by reference herein, discloses a printing unit with a rotatable print cylinder and a rotatable blanket cylinder. A tubular printing blanket is removably mounted on the blanket cylinder. The printing unit may have an imaging unit mounted therein. A printing member, which is mountable on the print cylinder, is imaged by the imaging unit inside the printing unit. The printing member has a continuous surface and may be removed axially from the print cylinder. The printing unit may be configured as a cantilever printing unit, or, alternatively, may be configured with both a gear side frame and a work side frame for supporting the print and blanket cylinders. In order to provide a variable-cutoff capability, a plurality of print cylinder saddles may be provided. Each print cylinder saddle has the same inner diameter for mounting on the print cylinders. However, in order to provide a variable cut-off, the print cylinder saddles may have a variety of outer diameters.

U.S. Pat. No. 8,850,975 discloses a variable cutoff printing unit that includes a plate cylinder, a plate cylinder support removably supporting the plate cylinder, a blanket cylinder; a blanket cylinder support removably supporting the blanket cylinder, a sliding element coupled to the blanket cylinder support for moving the blanket cylinder support toward and away from the plate cylinder support, and a stopping device for stopping movement of the sliding element to limit the movement of the blanket cylinder toward and away from the plate cylinder to a defined range.

BRIEF SUMMARY OF THE INVENTION

In accordance with an embodiment of the present invention, a printing unit for a web fed offset printing press is provided that includes a plate cylinder, a blanket cylinder; and an impression cylinder, and a web displacer, the web displacer movable between a first position and a second position, wherein in the first position, the web displacer does not contact the web passing between the blanket cylinder and the impression cylinder, and wherein in the second position the web displaces holds the web in contact with the impression cylinder and away from the blanket cylinder.

In accordance with another embodiment of the present invention, a printing unit is provided for printing on a web. The printing unit includes a plate cylinder, a blanket cylinder, an impression cylinder; a web displacement bar, and an actuator. The web displacement bar is movable between a first position in which the web displacement bar is spaced apart from a web passing between the blanket cylinder and the impression cylinder, and a second position in which the web displacement bar holds the web in contact with the impression cylinder and spaced apart from the blanket cylinder. The actuator is coupled to the web displacement bar, and the actuator is operable to move the web displacement bar between the first and second positions. In accordance with another embodiment of the present invention, a printed press is provided which includes the aforementioned printing unit.

In accordance with yet another embodiment of the present invention, a method of operating a printing press including a printing unit including a plate cylinder, a blanket cylinder, and an impression cylinder, and a web displacement bar is provided. The method includes passing a web through a nip formed between the blanket cylinder and the impression cylinder, wherein the web is partially wrapped around the blanket cylinder, and wherein the web is not in contact with the web displacement bar; separating the blanket cylinder and the impression cylinder, wherein the web remains in contact with the blanket cylinder and is spaced apart from the impression cylinder; and moving the web displacement bar downward and into contact with the web to move the web out of contact with the blanket cylinder and into contact with the impression cylinder.

In accordance with further variants of the above referenced embodiments of the present invention, the web displacement bar may comprise an elongated rod that extends substantially across a length of the blanket cylinder, or an elongated roller that extends substantially across a length of the blanket cylinder, or a plurality of rollers that extend substantially across a length of the blanket cylinder, or other elongated structures arranged to move the web between the first and second positions.

In accordance with other and/or further variants of the above referenced embodiments of the present invention, the web displacement bar may be secured to the actuator, and the actuator secured to the printing unit. Further, the actuator may be secured to a blanket cylinder support of the printing unit.

In accordance with other and/or further variants of the above referenced embodiments of the present invention, the actuator may include a pair of pneumatic cylinders. Alternatively, other actuators may be used, such as motor driven screw spindles, carriages, hydraulic pistons, and the like.

In accordance with other and/or further variants of the above referenced embodiments of the present invention, wherein the printing unit may be a variable cut-off printing unit. Further, the actuator may be secured to a movable blanket cylinder support of the printing unit.

BRIEF DESCRIPTION OF THE DRAWINGS

The present invention is described below by reference to the following drawings, in which.

DETAILED DESCRIPTION

Figure 1:
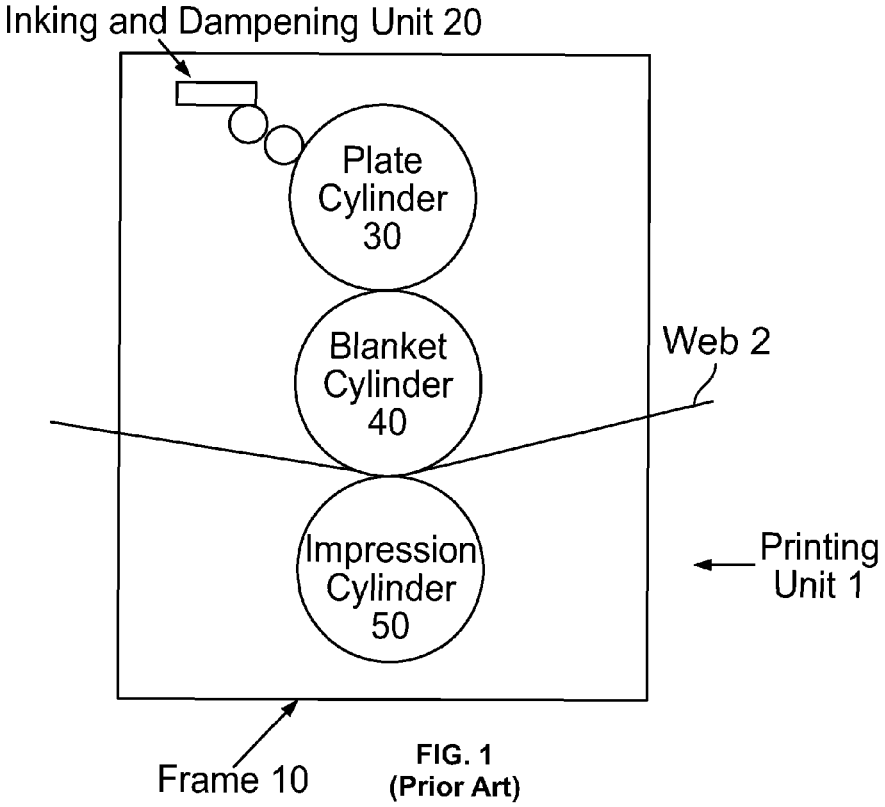
FIG. 1 (Prior Art)
FIG. 1 is a schematic illustration of a prior art web offset printing unit printing on a web.

In accordance with embodiments of the present invention, a web displacer is provided in a printing unit for a non-perfecting packaging press. In this regard, packaging presses are printing presses which are designed for printing on packaging, such as plastic films, other films with a low modulus of elasticity, as well as stiffer materials such as cardboard. Printing on web of films with a low modulus of elasticity such as plastic or polyethylene films can be challenging because such films are more stretchable and also more prone to breakage than, for example, a paper web. In a typical non-perfecting packaging press, the web is wrapped partially around the blanket cylinder as it passes between the blanket cylinder and impression cylinder in the printing unit. One reason for this is that in such a press, a spreader roller is typically provided upstream of the printing unit to spread the elastic web so that it can be effectively printed.

In any event, due to this arrangement, the web typically remains in contact with the blanket cylinder when the printing unit is in throw-off position. As one of ordinary skill in the art will appreciate, "throw off" refers to separating the blanket cylinder from the impression cylinder, and/or separating the plate cylinder from the blanket, and/or separating the plate cylinder from the inking and/or dampening unit. There are a number of reasons for placing a printing unit in throw off position, including for example: to change printing plate (plate change), to wash the printing blanket on the blanket cylinder (blanket washing), to change the blanket on the blanket cylinder (blanket change), or for other maintenance. If the press is a variable cut-off press, a printing unit would also be placed in throw off position for changing plate or blanket cylinder sizes. In contrast to throw-off position, a printing unit is said to be in printing position when the plate cylinder is in contact with the blanket cylinder and the blanket cylinder is in contact with the impression cylinder.

Throw-off mechanisms are well known in the art and will not be discussed in detail herein. There are a wide variety of well-known mechanisms that can be used to effect "throw off". Non-limiting examples include mounting the plate and/or blanket and/or impression cylinders: in eccentric bearings, on pivotable brackets; on screw spindles, on tracks or carriages, and combinations of the foregoing. These mechanisms can be actuated by a controller with a wide variety of actuators, including motors, hydraulic cylinders, pneumatic cylinders, and the like.

For purposes of the present application, the term "impression cylinder throw off position" shall mean that the impression cylinder is spaced apart from the blanket cylinder, regardless of whether this separation was effected by moving the impression cylinder, the blanket cylinder or both. In this context, when a printing unit is in impression cylinder throw off position, the blanket cylinder may or may not be separated from the plate cylinder, and the plate cylinder may or not be separated from the inking and/or dampening unit.

For purposes of the present application, the term "printing position" shall mean that the plate cylinder is in contact with the blanket cylinder and the blanket cylinder is in contact with the impression cylinder.

Packaging press printing units are typically, though not necessarily, variable cut-off printing units. A variable cutoff printing unit as used herein refers to a printing unit that can be modified between print jobs so that the printing unit can print repeating images of different lengths during different print jobs. The length of the repeating images printing during a particular print job is commonly referred to as a cutoff length or a cutoff. Plate cylinders and blanket cylinders that print the repeating images for the particular print job (and the plates and blanket mounted on the cylinders) may be said to have that cutoff length or cutoff. For example, a variable cutoff printing unit can print repeating images of a first cutoff length on a web or other substrate during a first print job and then can print repeating images of a second cutoff length that varies from the first cutoff length on a web or other substrate during a subsequent second print job. The first print job is printed using a first plate cylinder and a first blanket cylinder each having an outer circumference with a circumferential length corresponding to the first cutoff length. After the first print job and before the second print job, the first plate cylinder and the first blanket cylinder are removed from the printing unit and replaced with a second plate cylinder and a second blanket cylinder that each have outer circumferences with a circumferential length corresponding to the second cutoff length. A change between print jobs that involves replacing printing plates and blankets having a first cutoff length with printing plates and blankets having a second cutoff length may be referred to as a cutoff change.

As explained above, in a typical non-perfecting packaging press, the web is wrapped partially around the blanket cylinder as it passes between the blanket cylinder and impression cylinder in the printing unit, and due to this arrangement, the web typically remains in contact with the blanket cylinder when the printing unit is in impression cylinder throw-off position. This can be problematic in that it is often necessary to rotate the blanket cylinder relative to the static (unmoving) web while the printing unit is in impression cylinder throw-off position. When this happens the web will typically stick on the tacky blanket and cause the web to stretch and often break. This is particularly likely when the web is a film web with a low modulus of elasticity such as plastic or polyethylene film webs.

One conventional method to try to alleviate this problem and prevent web breakage was to release the tension from the web. However, this is not reliable, in part, because the tackiness of the blanket may still cause the web to stretch or break even in the absence of applied tension.

In accordance with various embodiments of the present invention, a printing unit for a web fed offset printing press is provided that includes a plate cylinder, a blanket cylinder; and an impression cylinder, and a web displacer. When the printing unit is in the impression cylinder throw-off position, the web displacer is selectively movable between a first position and a second position via an actuator. In the first position, the web displacer does not contact the web passing between the blanket cylinder and the impression cylinder, and in the second position the web displacer holds the web in contact with the impression cylinder and away from the blanket cylinder.

FIG. 1 shows, schematically, a prior art non-perfecting printing unit 1 in a packaging press. Although a single printing unit is shown, it should be understood that the packaging press may include a plurality of printing units 1, along with other conventional press components such as an infeed, dryer, chill roll stand, tensioning devices, spreader rollers and the like. The printing unit includes a frame 10 in which is supported an inking and dampening unit 20, a plate cylinder 30, a blanket cylinder 40, and impression cylinder 50, which are driven by one or more drive motors as is well known in the art. From the perspective of FIG. 1, a web 2 travels through printing unit from left to right.

Figure 2A:
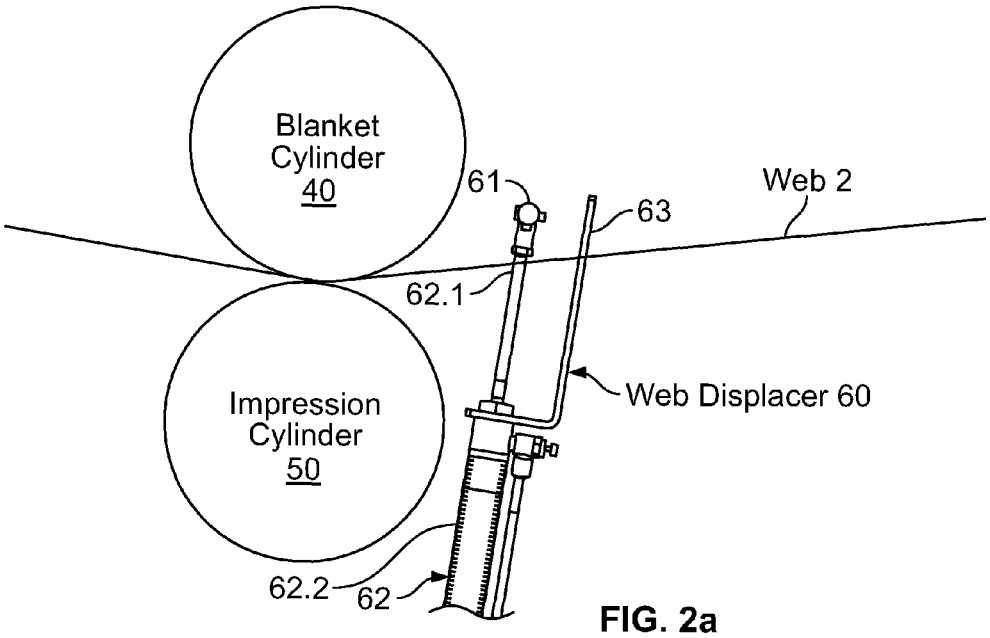
FIG. 2*a* shows a side view of the web offset printing unit of FIG. 1 including a web displacer in accordance with the present invention, with the printing unit printing on the web and the web displacer in a first position spaced apart from the web.
Figure 2B:
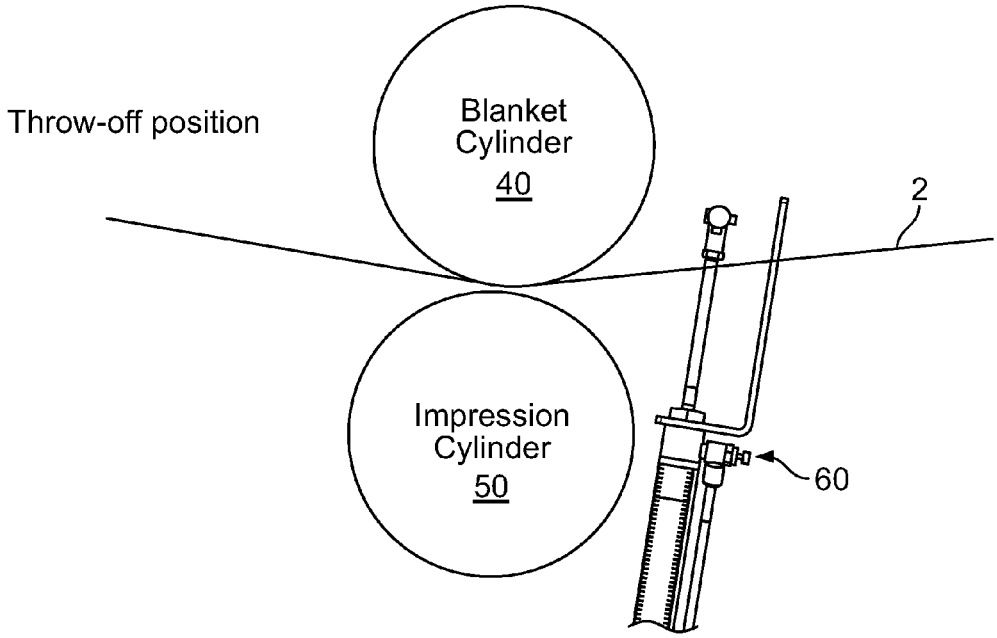
FIG. 2*b* shows the printing unit of FIG. 2*a* in a throw-off position with the web displacer in the first position spaced apart from the web.
Figure 2C:
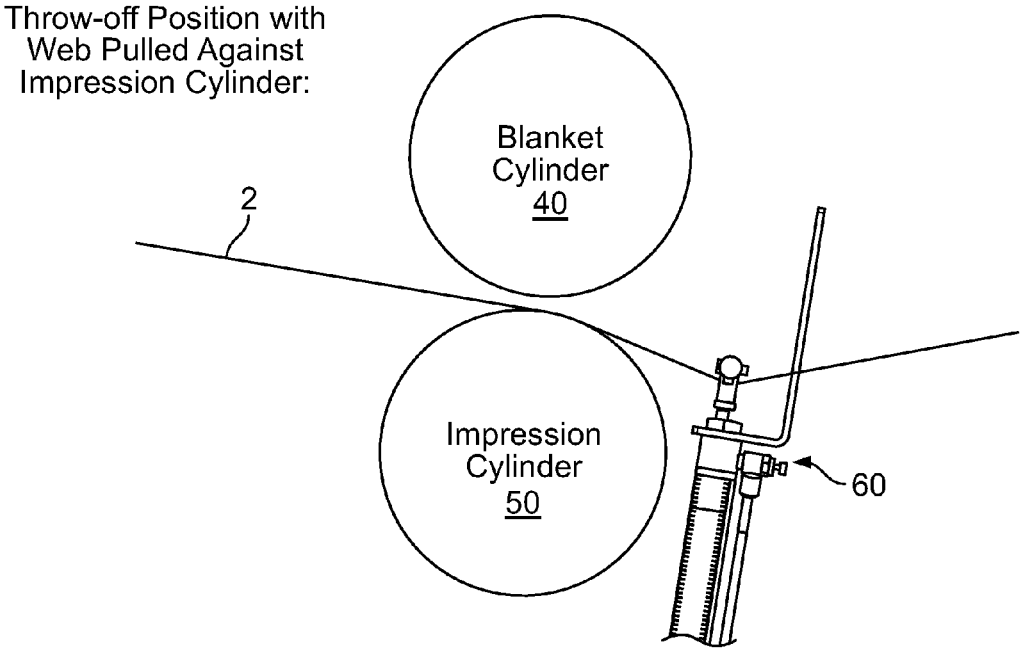
FIG. 2*c* shows the printing unit of FIG. 2*b*, with the web displacer in a second position, holding the web in contact with the impression cylinder and spaced-apart from the blanket cylinder.
Figure 3:
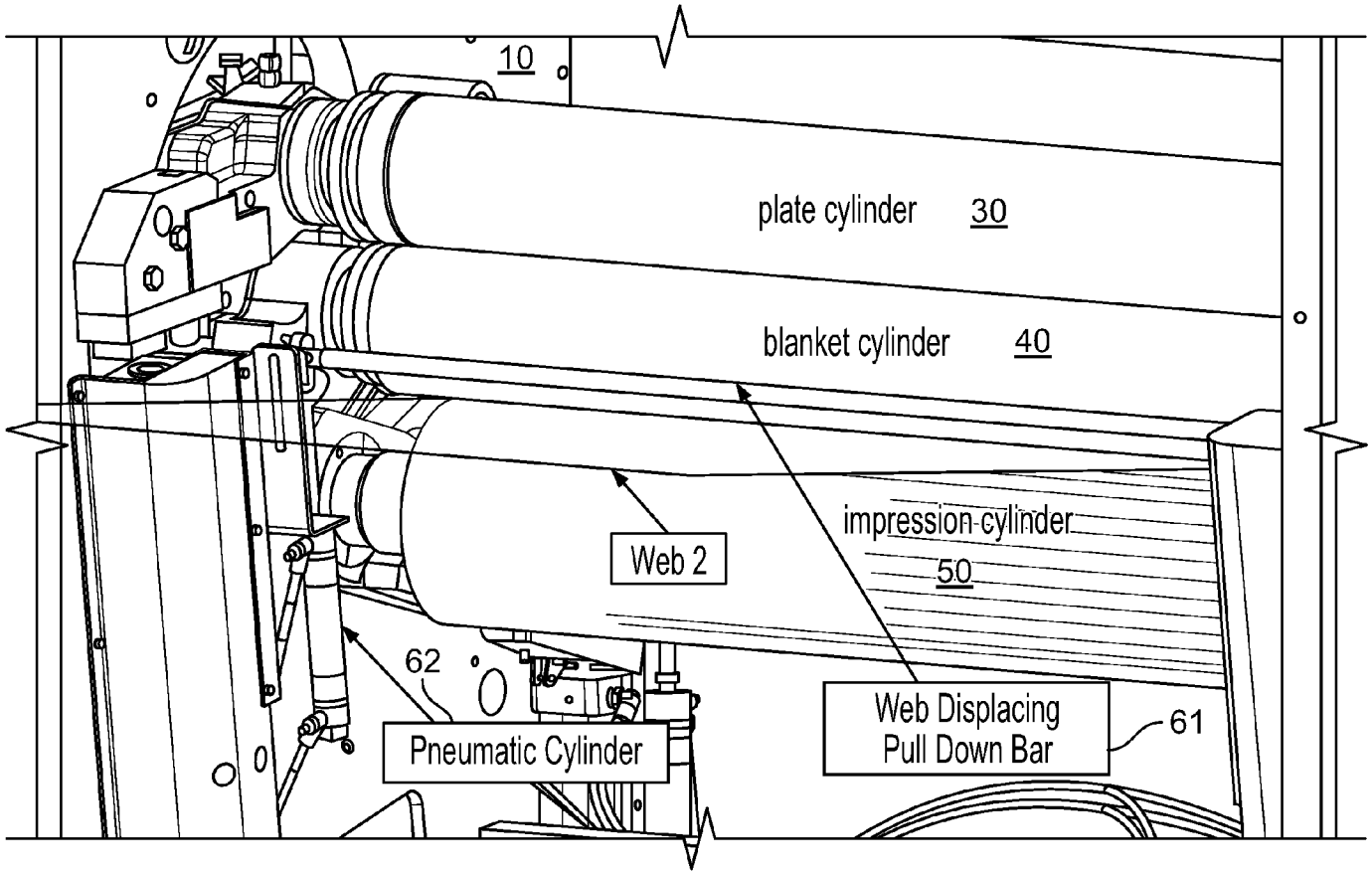
FIG. 3 shows a perspective view of an exemplary printing unit and web displacer in accordance with an embodiment of the present invention, including a pneumatic actuator.

FIG. 2 (*a-c*) schematically show a printing unit in accordance with FIG. 1 which includes a web displacer 60 in accordance with the present invention in normal running (e.g. printing) position (FIG. 2*a*.), in an impression cylinder throw off position (FIG. 2*b*), and in the impression cylinder throw off position with the web pulled against the impression cylinder (FIG. 2*c*). FIG. 3 shows a perspective view of the web displacer 60 positioned within the printing unit 1. Web displacer 60 may include a web displacement bar 61 in the form of a pull down bar which extends substantially across the length of the blanket cylinder 40. The web displacement bar 61 is movable between a first position (e.g., illustrated in FIGS. 2*a* and 2*b*) and a second position (e.g., illustrated in FIG. 2*c*). In the first position, the web displacement bar 61 is spaced apart from the web 2 (FIGS. 2*a* and 2*b*). In the second position (FIG. 2*c*), the web displacement bar 61 holds the web 2 in contact with the impression cylinder 50 and spaced away from the blanket cylinder 40. The web displacer may include an actuator to effect movement of the web displacement bar 61 between the first and second positions.

Preferably, the actuator includes a pair of pneumatic cylinders 62, each having a piston rod 62.1 and cylinder 62.2, wherein the piston rod 62.1 moves between an extended position (FIGS. 2*a* and 2*b*) and a retracted position (FIG. 2*c*). The web displacement bar 61 is secured, at each end thereof, to one of the piston rods 62.1. Each pneumatic cylinder 62 is mounted in position relative to the blanket and impression cylinders (40, 50) via a mounting bracket 63. Alternatively, other actuators may be used, such as motor driven screw spindles, carriages, hydraulic pistons, and the like.

An illustrative method for using the web displacer during the operation of the printing unit will now be described with reference to FIGS. 2(*a-c*). As discussed above, during a printing operation, the printing unit is "printing position", meaning that the plate cylinder is in rolling engagement with the blanket cylinder at the plate-blanket cylinder nip and the blanket cylinder is in rolling engagement with the impression cylinder at the blanket-impression cylinder nip. When the printing unit is in printing position (FIG. 2*a*), the web 2 is printed as it passes through the nip formed between the blanket cylinder 40 and the impression cylinder 50. As illustrated, the web 2 is partially wrapped around the blanket cylinder 40.

While the printing unit is in printing position (FIG. 2*a*), the web displacement bar 61 is located vertically above and spaced apart from the web 2. In the illustrated embodiment, this is accomplished by having the pneumatic cylinders 62 (only one being visible as it is a side view) in their extended position.

At some point in time it will become necessary to stop printing and place the printing unit in throw-off position. As noted above, there are a number of reasons for placing a printing unit in throw off position, including for example: to change printing plate (plate change), to wash the printing blanket on the blanket cylinder (blanket washing), to change the blanket on the blanket cylinder (blanket change), or for other maintenance. If the press is a variable cut-off press, a printing unit would also be placed in throw off position for changing plate or blanket cylinder sizes. As noted above, "throw off" refers to separating the blanket cylinder from the impression cylinder, and/or separating the plate cylinder from the blanket, and/or separating the plate cylinder from the inking and/or dampening unit. In this case, we are concerned with "impression cylinder throw off position" meaning that the impression cylinder is spaced apart from the blanket cylinder, regardless of whether this separation was effected by moving the impression cylinder, the blanket cylinder or both, and regardless of whether or not the plate cylinder is separated from the blanket, and/or the plate cylinder is separated from the inking and/or dampening unit. This is shown in FIG. 2*b*, where impression cylinder 50 is separated from blanket cylinder 40. As illustrated, due to the fact that the web is partially wrapped around the blanket cylinder 40, the web 2 remains in contact with the blanket cylinder when the printing unit is moved from the printing position to impression cylinder throw off position.

FIG. 2(*c*) illustrates the printing unit in impression cylinder throw off position, with the web displacer 60 actuated so that the web displacement bar 61 holds the web 2 against the impression cylinder 50 and spaced away from the blanket cylinder 40. The web displacer 60 is actuated via the pneumatic cylinder 62. In particular, the pneumatic cylinder 62 moves from a first position in which the rod 62.1 is extended (FIG. 2*b*) to a second position in which the rod 62.1 is retracted (FIG. 2*c*). The pneumatic cylinder 62 itself is controlled by a controller in a conventional manner. The controller could, for example be a push-button or HMI (Human Machine Interface) on the work side of the printing unit or a controller elsewhere on the press or in the pressroom.

Often on packaging presses, it necessary to rotate the plate, blanket and impression cylinders relative to the static web while the printing unit is in impression cylinder throw-off; for example during a plate change operation, a blanket change operation, or a blanket washing operation. When this happens the web will typically contact the tacky blanket and cause the web to be stretched and very often break. These results in the press having to be rewebbed which takes considerable time.

The web displacement bar 61 enables the print cylinders to be rotated relative to the static web by pulling the web down against the smooth impression cylinder 50. Even though the impression cylinder 50 rotates relative to the web 2, the surface is smooth and non-tacky such that the web does not stretch or tear.

Figure 5A:
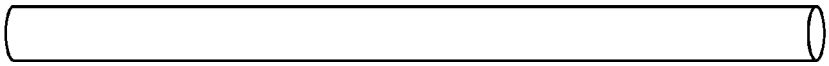
FIG. 5(*a*) through 5(*c*) show exemplary web displacement bars in accordance with embodiments of the present invention.
Figure 5B:
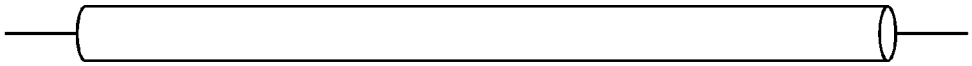
Figure 5C:
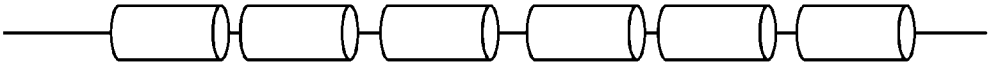

Preferably web displacement bar 61 is an elongated rod as shown in FIGS. 3 and 5*a*. However, as used herein, the term web displacement bar is not limited to rods, but rather broadly encompasses any elongated structure that can move the web. For example, web displacement bar 61 could be implemented as an elongated rod (FIG. 5*a*), or an elongated roller (FIG. 5*b*), or a plurality of rollers (FIG. 5*c*), which extend substantially across a length of the blanket cylinder.

As explained above, in a variable cut-off press, the cut-off is typically changed by replacing a first plate cylinder and the first blanket cylinder having outer circumferences with a circumferential length corresponding to the first cutoff length with a second plate cylinder and a second blanket cylinder that each have outer circumferences with a circumferential length corresponding to the second cutoff length. In order to effect this change, it is typically necessary to move at least two of the three printing unit cylinders (the blanket cylinder, the plate cylinder, and the impression cylinder) to accommodate the change in size of the plate and blanket cylinders. As a result, the relative positions of the blanket cylinder and impression cylinder may change when the cut-off is changed.

It is therefore advantageous to mount the web displacer assembly 60 in the printing unit so that its position changes when the cut-off is changed. Preferably, the web displacer assembly 60 is mounted to the movable support of either the blanket cylinder 40 or the impression cylinder 50. Most preferably it is mounted to the movable blanket cylinder support.

Figure 4:
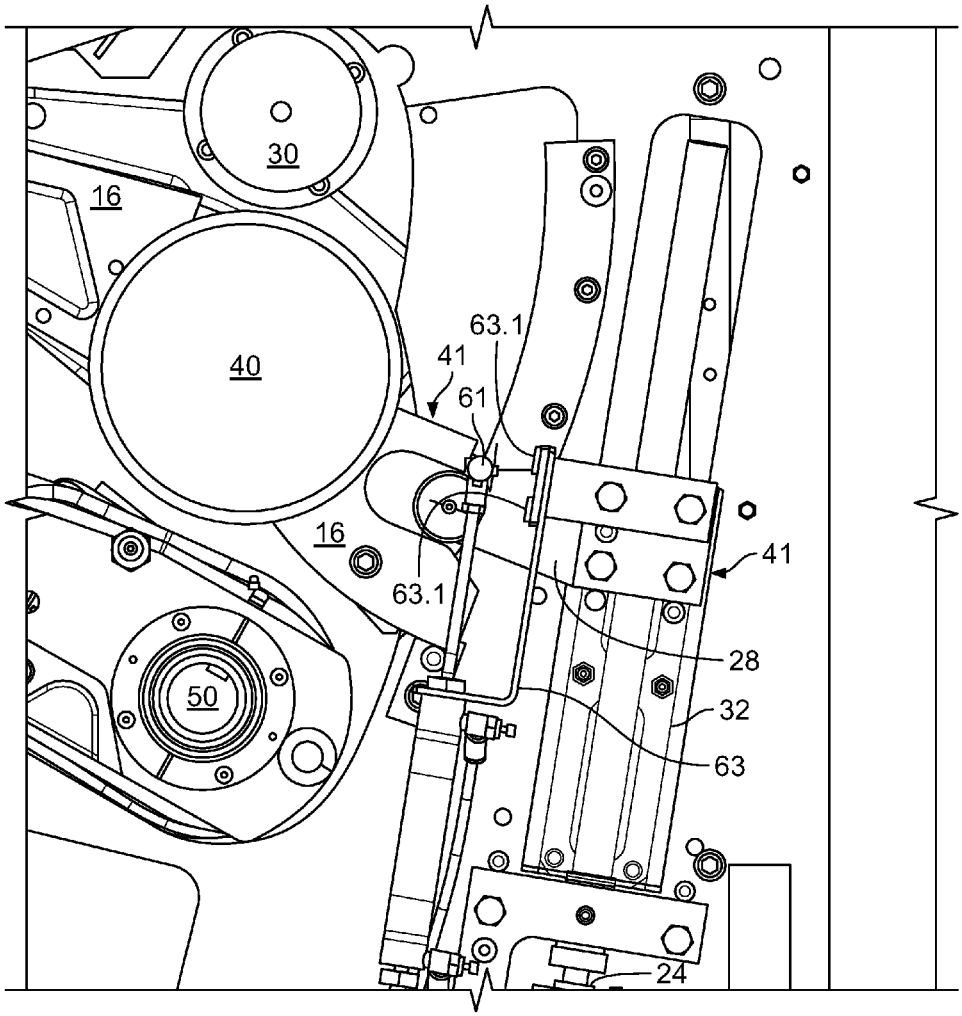
FIG. 4 shows a side view of an exemplary printing unit and web displacer in accordance with an embodiment of the present invention, including a pneumatic actuator, and mounted to a screw spindle assembly of a blanket cylinder throw off mechanism.

FIG. 4 illustrates such an embodiment implemented in a variable cut-off printing unit of US 2014/0102325 to Caron, assigned to Goss International Americas, Inc., the entire disclosure of which is hereby incorporated by reference. In this regard, the movable blanket cylinder support 41 includes pivotable support 16, arm 28, sliding element 32, and actuator 24. Sliding element 32 and actuator 24 together form a motorized screw spindle. As the arm 28 moves under control of the screw spindle, the position of the support 16 changes to accommodate different blanket cylinder sizes. The mounting bracket 63 is secured to the arm 28 of the blanket cylinder support via fasteners 63.1 such as bolts. Accordingly, the web displacement bar 61 remains at the correct height regardless of the cut-off or repeat size of the printing unit.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing unit for printing on a web, comprising:

a plate cylinder;

a blanket cylinder;

an impression cylinder;

a web displacement bar movable between a first position in which the web displacement bar is spaced apart from a web passing between the blanket cylinder and the impression cylinder, and a second position in which the web displacement bar holds the web in contact with the impression cylinder and spaced apart from the blanket cylinder; and an actuator coupled to the web displacement bar, the actuator operable to move the web displacement bar between the first and second positions.

2. The printing unit of claim 1, wherein the web displacement bar comprises an elongated rod that extends substantially across a length of the blanket cylinder.

3. The printing unit of claim 1, wherein the web displacement bar comprises an elongated roller that extends substantially across a length of the blanket cylinder.

4. The printing unit of claim 1, wherein the web displacement bar comprises a plurality of rollers that extend substantially across a length of the blanket cylinder.

5. The printing unit of claim 1, wherein the web displacement bar is secured to the actuator, and wherein the actuator is secured to the printing unit.

6. The printing unit of claim 5, wherein the actuator is secured to a blanket cylinder support of the printing unit.

7. The printing unit of claim 5, wherein the actuator includes a pair of pneumatic cylinders.

8. The printing unit of claim 5, wherein the printing unit is a variable cut-off printing unit, and wherein the actuator is secured to a movable blanket cylinder support of the printing unit.

9. A printing press for printing on a web, comprising:

a printing unit including a plate cylinder, a blanket cylinder, and an impression cylinder;

a web displacement bar movable between a first position in which the web displacement bar is spaced apart from a web passing between the blanket cylinder and the impression cylinder, and a second position in which the web displacement bar holds the web in contact with the impression cylinder and spaced apart from the blanket cylinder; and an actuator coupled to the web displacement bar, the actuator operable to move the web displacement bar between the first and second positions.

10. The printing press of claim 9, wherein the web displacement bar comprises an elongated rod that extends substantially across a length of the blanket cylinder.

11. The printing press of claim 9, wherein the actuator includes a pair of pneumatic cylinders.

12. The printing press of claim 9, wherein the printing unit is a variable cut-off printing unit, and wherein the actuator is secured to a movable blanket cylinder support of the printing unit.

* * * * *